US008733306B2

(12) United States Patent
Draheim

(10) Patent No.: US 8,733,306 B2
(45) Date of Patent: May 27, 2014

(54) CONTROL VALVE OF A DEVICE FOR CHANGING THE RELATIVE ANGULAR POSITION OF A CAMSHAFT WITH RESPECT TO A CRANKSHAFT OF AN INTERNAL COMBUSTION ENGINE

(75) Inventor: Alexander Draheim, Erlangen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/583,070

(22) PCT Filed: Feb. 8, 2011

(86) PCT No.: PCT/EP2011/051806

§ 371 (c)(1),
(2), (4) Date: Sep. 6, 2012

(87) PCT Pub. No.: WO2011/117019

PCT Pub. Date: Sep. 29, 2011

(65) Prior Publication Data

US 2012/0325169 A1 Dec. 27, 2012

(30) Foreign Application Priority Data

Mar. 24, 2010 (DE) ..... 10 2010 012 479

(51) Int. Cl.
*F01L 1/34* (2006.01)

(52) U.S. Cl.
USPC ..... 123/90.17; 137/625.25; 123/90.15

(58) Field of Classification Search
USPC ..... 123/90.15, 90.17, 90.31; 137/625.25
See application file for complete search history.

(56) References Cited

U.S. PATENT DOCUMENTS

| | | | | |
|---|---|---|---|---|
| 2007/0095315 | A1 | 5/2007 | Hoppe et al. | |
| 2009/0145386 | A1 | 6/2009 | Ushida | |
| 2010/0288384 | A1 * | 11/2010 | Hoppe et al. | 137/843 |

FOREIGN PATENT DOCUMENTS

| | | |
|---|---|---|
| DE | 3825074 | 10/1989 |
| DE | 19611365 | 9/1997 |
| DE | 10346443 | 5/2005 |
| DE | 102008004591 | 7/2009 |
| DE | 102008030057 | 1/2010 |
| DE | 102008039038 | 2/2010 |
| EP | 0335083 | 2/1989 |
| WO | 0061920 | 10/2000 |

* cited by examiner

*Primary Examiner* — Zelalem Eshete
(74) *Attorney, Agent, or Firm* — Volpe and Koenig, P.C.

(57) ABSTRACT

A control valve (1) of a device (2) for changing the relative angular position of a camshaft (3) with respect to a crankshaft of an internal combustion engine, wherein, in a region (4) facing the camshaft (3), the control valve (1) includes a fluid line (5) for supplying fluid under pressure and wherein, in an axial central region (6), the control valve (1) includes two fluid lines (7, 8) for supplying and removing fluid under pressure to at least two hydraulic chambers. The hydraulic chambers are operatively arranged between a drive element (9) and the camshaft (3) in order to set a defined relative rotational position between the drive element (9) and the camshaft (3). In a region (10) facing away from the camshaft (3) the control valve (1) has a fluid line (11) for removal of fluid to a tank. In order to reduce wear on the device, according to the invention the fluid line (11) for removing fluid in a preferably hollow-cylindrical section (12) of the control valve (1) is in the form of at least one recess extending through the preferably hollow-cylindrical section (12) to an outside (13) of the section (12).

9 Claims, 4 Drawing Sheets

CONTROL VALVE OF A DEVICE FOR CHANGING THE RELATIVE ANGULAR POSITION OF A CAMSHAFT WITH RESPECT TO A CRANKSHAFT OF AN INTERNAL COMBUSTION ENGINE

FIELD OF THE INVENTION

The invention relates to a control valve of a device for changing the relative angular position of a camshaft with respect to a crankshaft of an internal combustion engine, wherein the control valve has, in an area facing the camshaft, a fluid line for feeding fluid under pressure, wherein the control valve has, in an axial middle area, two fluid lines for feeding fluid under pressure to and discharging fluid under pressure from at least two hydraulic chambers, wherein the hydraulic chambers are operatively arranged between a drive element and the camshaft, in order to set a defined relative rotational position between the drive element and the camshaft, and wherein the control valve has, in an area facing away from the camshaft, a fluid line for discharging fluid to a tank.

BACKGROUND

Camshaft adjusting devices, especially those that operate hydraulically, have been known for a long time in the prior art. In hydraulic camshaft adjusters, an impeller is provided in which vanes are formed or arranged. The vanes are located in hydraulic chambers that are formed in an outer rotor (usually called a stator). Through corresponding pressurization of respective sides of the hydraulic chambers with hydraulic fluid, the inner rotor (connected to the camshaft) is adjusted relative to the stator between an "advanced stop" and a "retarded stop."

Here, the flow of hydraulic oil is controlled by a control valve that is constructed according to the class and as an electrically controlled directional control valve. Such a control valve is disclosed in DE 10 2008 004 591 A1.

In such a control valve it is provided that pressure oil is guided from a high-pressure area through a fluid line formed by at least one borehole in the control valve in an area of the valve facing the camshaft into the interior of the valve. The valve has control elements with which the pressure oil can be fed in a controlled manner into two fluid lines in the axial middle area of the valve, wherein these fluid lines are in fluid connection with the hydraulic chambers of the camshaft adjuster. Through the corresponding flow of hydraulic oil into the hydraulic chambers, the relative rotation of the stator of the camshaft adjuster relative to the camshaft can be performed, which has been known for a long time. The oil is then fed back into a tank in an area of the valve facing away from the camshaft.

The previously noted DE 10 2008 004 591 A1 here provides that the oil is fed in the interior of the control valve and especially through the interior of the control piston (valve piston) and is discharged in the axial end area of the control piston through piston hollow space openings concentrically from the valve. In other words, the oil outflow to the tank is realized in the axial direction through the control valve constructed as a central valve.

A disadvantage in this solution is that, the rotor tappet of an electromagnetic actuator (central magnet) is arranged in the area of the outflow of the hydraulic oil, wherein this tappet contacts the control piston and moves in the axial direction in the necessary manner, in order to control the flow of hydraulic oil in the camshaft adjuster. This configuration allows contaminants (particles) in the oil to reach the contact position between the rotor tappet and the valve piston and to accumulate at this position and thus to subject this wear-sensitive location to abrasive particles. The result is correspondingly disadvantageous wear at the contact position.

It is also a disadvantage that, in some areas, higher temperatures occur in the camshaft adjuster in the area of the central magnet when the internal combustion engine is operating.

SUMMARY

The present invention is based on the object of improving a control valve of the type according to the class so that it is possible to protect the contact position between the rotor tappet of the central magnet and the valve piston before the entry of contaminants and thus to reduce the wear in the camshaft adjuster. The ability should also be created to be better able to cool the central magnet and possibly additional add-on parts.

The solution to meeting this object by the invention is characterized in that the fluid line for discharging fluid in an advantageously hollow cylindrical section of the control valve is constructed as at least one recess extending through the advantageously hollow cylindrical section to the outside of the section.

The fluid line for discharging fluid is preferably constructed as at least one borehole. It can be constructed by several recesses, in particular, boreholes, distributed around the periphery of the advantageously hollow cylindrical section. The at least one recess, in particular, the borehole, is oriented in the radial direction according to one embodiment of the invention.

An alternative construction provides that the at least one recess, in particular, the borehole, extends at an angle relative to the axial direction; the angle is here advantageously between 30° and 60°.

In the advantageously hollow cylindrical section of the control valve, usually a control piston is arranged that is contacted on its axial end facing away from the camshaft by a rotor tappet of an actuator. The actuator is here preferably constructed as an electromagnet. A longitudinal axis of the recess, in particular, the borehole, can meet an end face of the actuator for cooling.

The control valve is preferably constructed as a central screw and arranged with a threaded section in a threaded borehole in the camshaft.

Thus, according to the invention, oil that comes from the camshaft adjuster and is to be discharged into the tank is no longer discharged as in the prior art in the axial direction at the end face of the control valve, but instead through radial or inclined boreholes outside of the contact area between the rotor tappet of the central magnet and the valve piston. Thus, contaminants in the oil are led away from the rotor tappet—valve piston contact position.

With the proposed construction of a control valve of a hydraulic camshaft adjuster it is possible to lead the oil that comes from the control valve and is to be discharged into the tank so that much less oil is led into the contact area between the rotor tappet of the central magnet and the valve piston. In this way the wear at this sensitive contact position is significantly reduced, because fewer abrasive particles in the oil are fed to this position. A direct exposure of the contact position to discharging hydraulic oil is thus prevented.

With the proposal according to the invention it is further possible to cool the central magnet with the oil that is fed to the tank. The oil can be led especially through the oil discharge boreholes onto the surface of the central magnet, with this surface being provided for corresponding cooling of the central magnet.

It is also possible to feed the oil coming from the camshaft adjuster selectively onto the surface of a housing enclosing the camshaft adjusting system and/or onto the surface of an adjacent component through the inclined or radial oil discharge boreholes and to cool the oil on this surface as long as this surface is cooler than the oil.

It is also an advantage that there is improved discharge of the oil from the central valve, because the feeding of the oil is improved due to the centrifugal forces through the outflow fluid line (outflow boreholes) in the control valve. The oil can be discharged accelerated from the central valve. Through the camshaft rotating while the internal combustion engine is operating and the radial or inclined oil discharge boreholes, the generated centrifugal forces ensure that the oil is discharged from the control valve more quickly than in the prior art.

BRIEF DESCRIPTION OF THE DRAWINGS

Embodiments of the invention are shown in the drawings. Shown are.

DETAILED DESCRIPTION OF THE PREFERRED EMBODIMENTS

Figure 1:
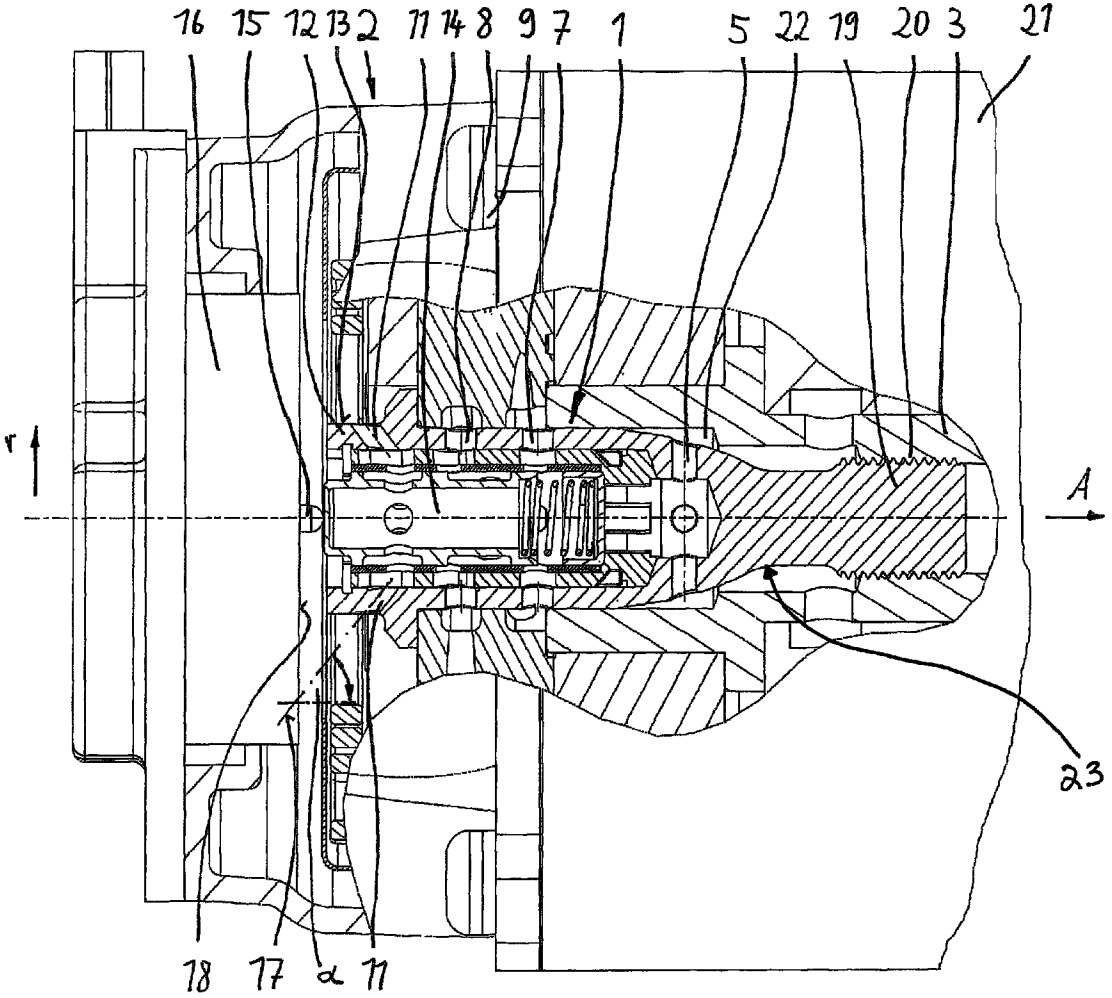
FIG. 1 a radial section through a part of an internal combustion engine with a device for changing the relative angular position of a camshaft with respect to a crankshaft of the internal combustion engine, thus, a camshaft adjuster, FIG. 2 a radial section of the control valve of the camshaft adjuster according to a first embodiment of the invention, FIG. 3 the control valve according to FIG. 2 in a perspective diagram, and FIG. 4 a radial section of the control valve of the camshaft adjuster according to a second embodiment of the invention.

In FIG. 1, part of an internal combustion engine is sketched, wherein a cylinder head 21 is shown in which a camshaft 3 is supported. The camshaft 3 is driven by means of a drive element 9 of a camshaft adjuster 2, wherein the drive element 9 has a (not shown) rotational connection to the (also not shown) crankshaft of the engine. In the camshaft adjuster 2 there is a hydraulic adjustment device that can implement an angular rotation between the drive element 9 and the camshaft 3, in order to influence, in a known way, the control times of the internal combustion engine. For this purpose, paired hydraulic chambers (not shown in more detail) are operatively arranged between the drive element 9 and the camshaft 3, wherein these chambers can be charged with pressurized fluid in order to be able to adjust the mentioned rotation. Several of these pairs of hydraulic chambers are arranged around the periphery. The camshaft adjuster 2 is thus used for changing the relative angular position of the camshaft 3 with respect to the crankshaft of the internal combustion engine.

The hydraulic oil in the hydraulic chambers is controlled by a control valve 1 that is constructed as a central valve and has, in an axial end area, a threaded section 19 that is screwed into a threaded borehole 20 in the camshaft 3.

The control valve 1 is activated by axial pressurization of a control piston 14 that is arranged in a valve housing 23 of the control valve 1 and is pressurized by an electromagnet 16 and especially by its rotor tappet 15 in the axial direction A.

Details on the construction and function of the camshaft adjuster 2 and especially the control valve 1 are described in the mentioned DE 10 2008 004 591 A1 of the applicant that is explicitly referenced in this extent. Most of the statements in this document also apply here, wherein the same construction and the same function of the control valve are basically given.

For the present invention, the following aspects are essential:

In an area 4 (see FIG. 2) facing the camshaft 3, the control valve 1 has a fluid line 5 for feeding fluid under pressure out from a high-pressure space 22. In the present case, the fluid line 5 comprises several boreholes that run in the radial direction r and allow hydraulic oil to enter into the interior of the control valve 1. In an axial center area 6 (see FIG. 2), the control valve 1 has two fluid lines 7 and 8 for feeding hydraulic oil under pressure to and for discharging hydraulic oil under pressure from the hydraulic chambers of the camshaft adjuster 2. In an area 10 facing away from the camshaft 3 (see FIG. 2), the control valve 1 has a fluid line 11 for discharging fluid to a tank.

Figure 2:
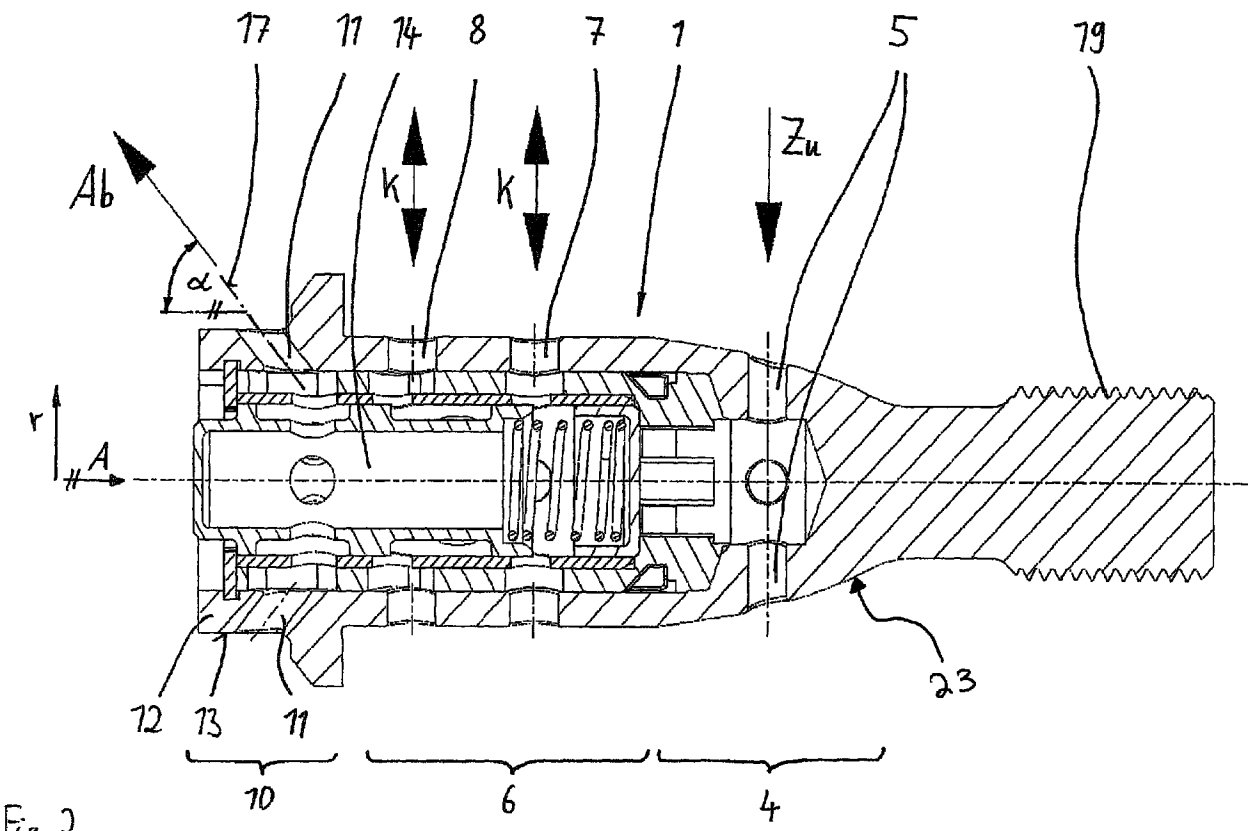

In FIG. 2, arrows indicate how oil flows from the high-pressure space 22 ("In") into the valve housing 23 of the control valve 1. This control valve feeds oil to or discharges oil from the chambers ("K"). Then the oil flows into the tank ("Out").

Starting from a construction of the control valve 1 described in this extent also in DE 10 2008 004 591 A1, it is provided according to the invention that the fluid line 11 is provided for discharging fluid to the tank in an advantageously hollow cylindrical section 12 of the control valve 1, wherein this fluid line is constructed as at least one recess 11 extending through the advantageously hollow cylindrical section 12 to the outside 13 of the section 12. The recess is preferably a borehole.

Figure 3:
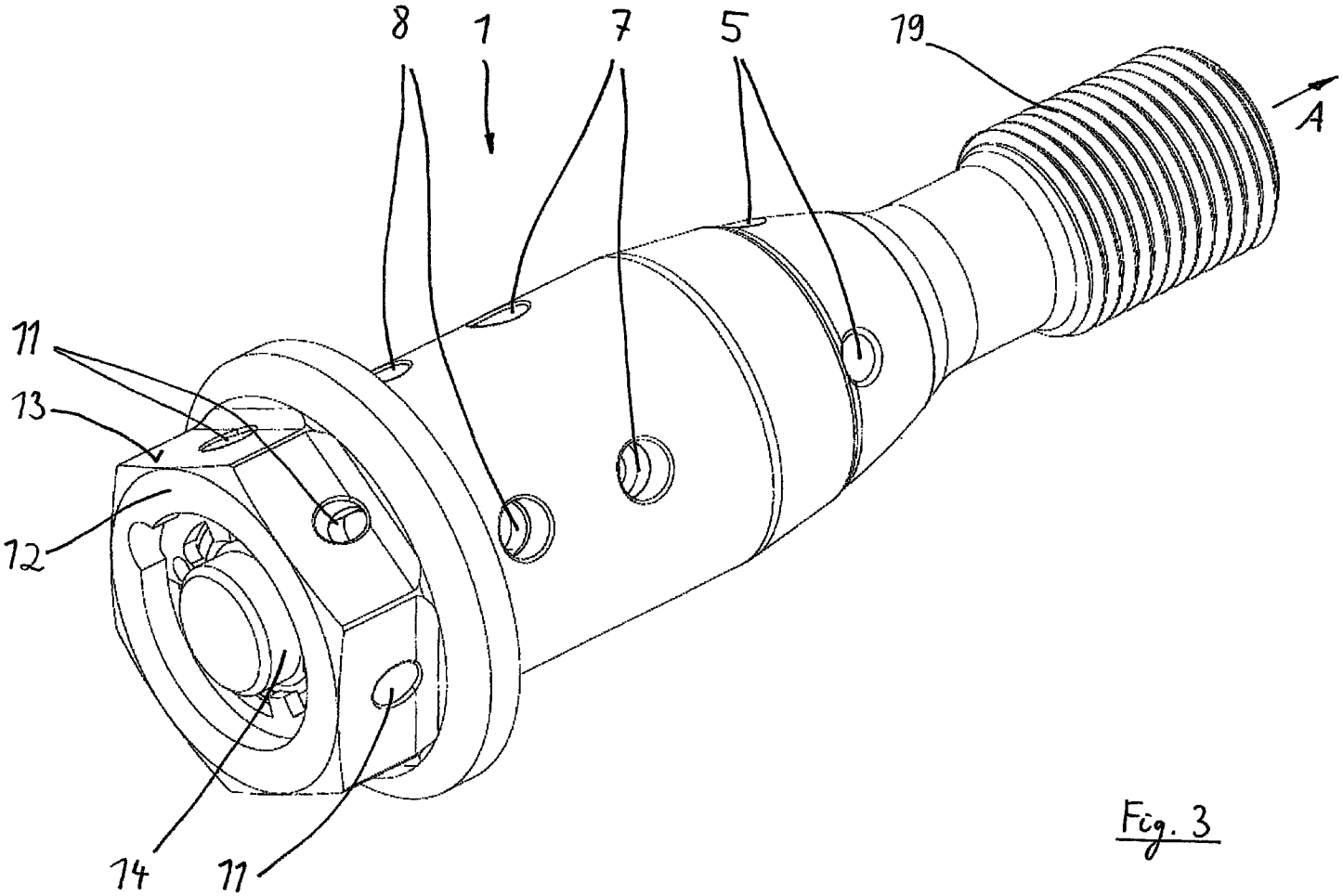

Accordingly, the hydraulic fluid flows in the proposed control valve 1 not in the axial direction out from the control valve 1 and in the direction of the contact of the rotor tappet 15 with the control piston 14, but instead it is discharged outward in the radial direction out from the control valve 1. As can be seen in FIGS. 1 to 3, the outflow fluid lines, i.e., the boreholes 11, are formed so that their longitudinal axis 17 is arranged at an angle $\alpha$ relative to the axial direction A, with this angle being approx. 45° in the embodiment.

In the embodiment according to FIGS. 1 to 3 and especially in FIG. 3 it can also be seen that the section 12 is not constructed as an ideal hollow cylindrical section, but instead the hollow cylindrical section has, on the outside, a hexagonal form, with a borehole 11 that extends outward at the angle $\alpha$ being formed in each of the six outside faces 13 of the hexagon.

As can be seen in FIG. 1, the flow of the discharged oil can be led onto the end face 18 of the central magnet 16 that is cooled in this way.

Figure 4:
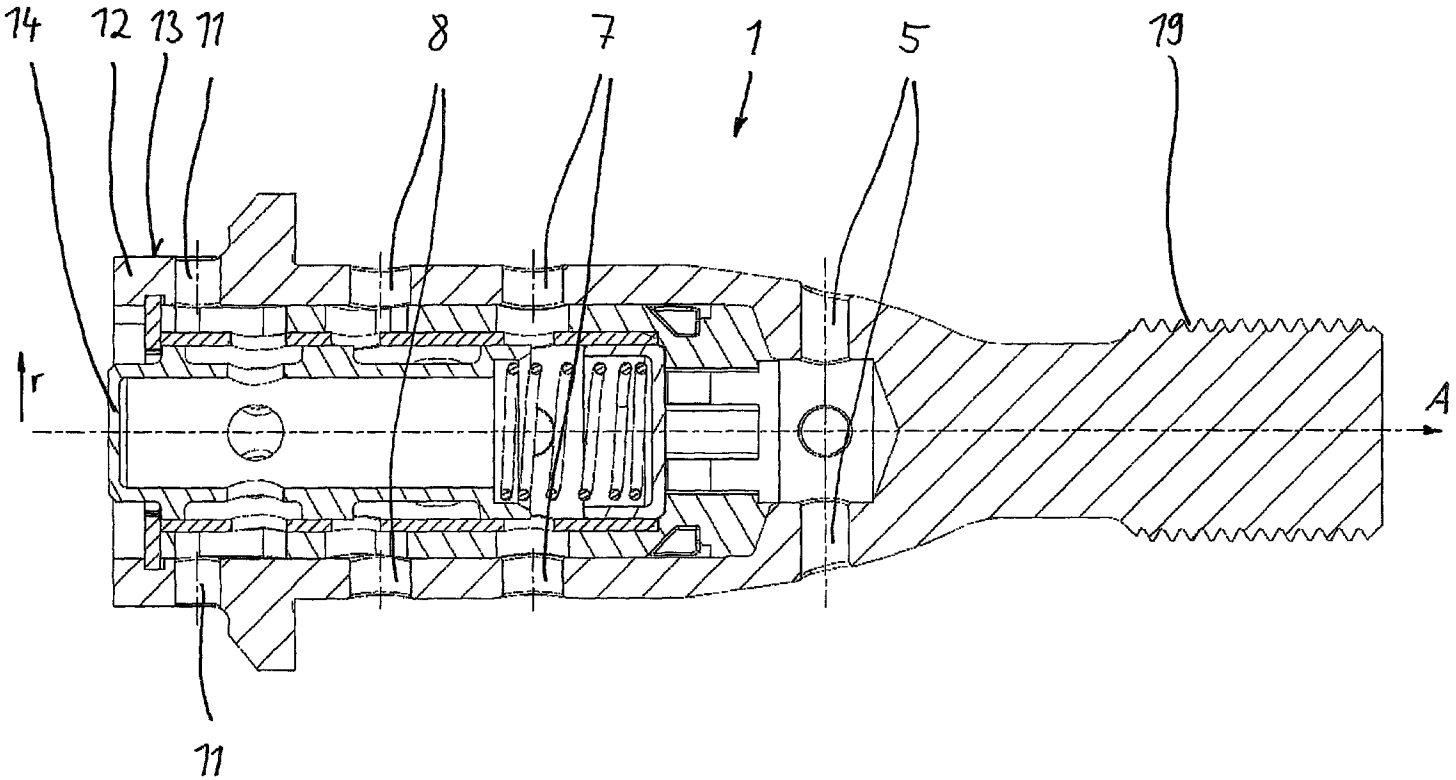

The solution according to FIG. 4 corresponds largely to that according to FIG. 2, wherein only the oil discharge boreholes, i.e., the recesses 11, here run in the radial direction, not at an angle $\alpha$.

In the axial end area (head area) of the control valve 1 or on sections of the control valve not covered by the rotor or other components, there is, according to the invention, at least one oil inclined discharge borehole that runs in the radial direction or at an angle and by means of which the oil coming from the camshaft adjuster is discharged in the direction of the tank.

Advantageously, the oil discharge boreholes are constructed so that the control valve housing is drilled from the outside.

The boreholes are preferably shaped or oriented so that they meet on the surface of the central magnet. The boreholes could also be constructed or oriented so that they meet on the surface of a housing covering the camshaft adjuster system or they meet at a different component.

LIST OF REFERENCE SYMBOLS

1 Control valve
2 Device (camshaft adjuster)
3 Camshaft
4 Facing area
5 Fluid line
6 Middle area
7 Fluid line
8 Fluid line
9 Drive element
10 Facing away area
11 Fluid line
12 Hollow cylindrical section
13 Outside
14 Control piston
15 Rotor tappet
16 Actuator (electromagnet)
17 Longitudinal axis
18 End face
19 Threaded section
20 Threaded borehole
21 Cylinder head
22 High-pressure space
α Angle
r Radial direction
A Axial direction
In Inflow
Out Outflow to tank
K Hydraulic oil flow to and from the hydraulic chambers

The invention claimed is:

1. Control valve of a device for changing a relative angular position of a camshaft with respect to a crankshaft of an internal combustion engine, the control valve comprising: a valve housing with a control piston movable within a bore in the valve housing, and in an area facing the camshaft, a supply fluid line for feeding fluid under pressure into the valve housing, in an axial middle area, two working fluid lines in the valve housing for feeding fluid under pressure to and for discharging fluid under pressure from at least two hydraulic chambers operatively arranged between a drive element and the camshaft, in order to adjust a defined relative rotational position between the drive element and the camshaft, and in an area facing away from the camshaft, a discharge fluid line for discharging fluid to a tank, the discharge fluid line is constructed for discharging the fluid in a hollow cylindrical section of the valve housing and is formed as at least one recess extending in a radial direction and through the hollow cylindrical section of the valve housing to an outside of the section.

2. Control valve according to claim 1, wherein the discharge fluid line is formed as at least one borehole in the valve housing for discharging the fluid.

3. Control valve according to claim 1, wherein the discharge fluid line is formed by several recesses, distributed around a periphery of the hollow cylindrical section.

4. Control valve according to claim 1, wherein the discharge fluid line is formed as at least one recess in the valve housing that extends at an angle (α) relative to an axial direction.

5. Control valve according to claim 4, wherein the angle (α) is between 30° and 60°.

6. Control valve according to claim 1, wherein in the hollow cylindrical section of the valve housing, the control piston is contacted on an end thereof facing away from the camshaft by a rotor tappet of an actuator.

7. Control valve according to claim 6, wherein the actuator is constructed as an electromagnet.

8. Control valve according to claim 6, wherein a longitudinal axis of the recess meets an end face of the actuator.

9. Control valve according to claim 1, wherein the control valve is provided in a central screw and is arranged with a threaded section in a threaded borehole in the camshaft.

* * * * *